US011111460B2

(12) United States Patent
Zhang et al.

(10) Patent No.: US 11,111,460 B2
(45) **Date of Patent: *Sep. 7, 2021**

(54) METHOD FOR PREPARING STABLE COMPOSITION WITH PERFUME

(71) Applicant: RHODIA OPERATIONS, Paris (FR)

(72) Inventors: Hai Zhou Zhang, Singapore (SG); Nikolay Christov, Singapore (SG); Da Wei Jin, Singapore (SG); Lin He, Singapore (SG)

(73) Assignee: RHODIA OPERATIONS, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/318,889

(22) PCT Filed: Jun. 18, 2015

(86) PCT No.: PCT/EP2015/063701

§ 371 (c)(1),
(2) Date: Dec. 14, 2016

(87) PCT Pub. No.: WO2015/193429

PCT Pub. Date: Dec. 23, 2015

(65) Prior Publication Data

US 2017/0137750 A1 May 18, 2017

(30) Foreign Application Priority Data

Jun. 18, 2014 (EP) ..... 14173005

(51) Int. Cl.

| | |
|---|---|
| ***C11D 3/37*** | (2006.01) |
| ***C11D 3/00*** | (2006.01) |
| ***C11D 3/22*** | (2006.01) |
| ***C11D 1/62*** | (2006.01) |
| ***C11D 3/50*** | (2006.01) |
| ***C11D 11/00*** | (2006.01) |
| ***C11D 1/835*** | (2006.01) |
| ***B65D 1/02*** | (2006.01) |
| ***B65D 41/04*** | (2006.01) |
| ***B65D 25/40*** | (2006.01) |
| ***C11D 3/30*** | (2006.01) |
| ***C11D 1/66*** | (2006.01) |

(52) U.S. Cl.

CPC ..... *C11D 3/001* (2013.01); *B65D 1/02* (2013.01); *B65D 25/40* (2013.01); *B65D 41/04* (2013.01); *C11D 1/62* (2013.01); *C11D 1/66* (2013.01); *C11D 1/835* (2013.01); *C11D 3/0015* (2013.01); *C11D 3/222* (2013.01); *C11D 3/227* (2013.01); *C11D 3/30* (2013.01); *C11D 3/50* (2013.01); *C11D 11/0017* (2013.01); *C11D 11/0094* (2013.01)

(58) Field of Classification Search

CPC ..... C11D 3/001; C11D 3/3742; C11D 3/227; C11D 3/373; C11D 3/3773; C11D 1/62; C11D 3/3765; C11D 3/0015; C11D 3/18; C11D 3/222; C11D 3/3738; C11D 1/008; C11D 11/0017; C11D 3/3951; C11D 3/40; C11D 3/50; C11D 17/0026; C11D 1/02; C11D 3/3723; C11D 3/3746

See application file for complete search history.

(56) References Cited

U.S. PATENT DOCUMENTS

| | | | | |
|---|---|---|---|---|
| 6,492,322 | B1 * | 12/2002 | Cooper | C11D 1/62 510/516 |
| 10,155,918 | B2 * | 12/2018 | Zhang | C11D 3/225 |
| 10,717,947 | B2 * | 7/2020 | Zhang | C11D 1/62 |
| 2014/0206587 | A1 * | 7/2014 | Chen | A61K 8/66 510/119 |

FOREIGN PATENT DOCUMENTS

| | | | |
|---|---|---|---|
| CA | 2444206 | A1 | 4/2004 |
| CN | 1292024 | A | 4/2001 |
| CN | 202609228 | U | 12/2012 |
| DE | 2925859 | A1 | 1/1981 |
| EP | 1062312 | * | 4/2005 |
| WO | 0146361 | A1 | 6/2001 |
| WO | 2007057859 | A2 | 5/2007 |

OTHER PUBLICATIONS

Machine Translation of CN1292024A.
Machine Translation of CN202609228U.

* cited by examiner

*Primary Examiner* — John R Hardee
(74) *Attorney, Agent, or Firm* — Vorys, Sater Seymour and Pease LLP

(57) ABSTRACT

The present invention relates to method for preparing composition containing at least a quaternary ammonium compound, a cationic polysaccharide, a fragrance material or perfume, a nonionic surfactant, and optionally a nonionic polysaccharide. The method notably comprises a step of preparing a premix of the fragrance material or perfume and the nonionic surfactant. Said composition may notably be used for fabric conditioning.

16 Claims, No Drawings

METHOD FOR PREPARING STABLE COMPOSITION WITH PERFUME

This application claims priority to European application no. 14173005.1 filed on Jun. 18, 2014 and PCT international patent application no. PCT/EP2015/051718 filed on Jan. 28, 2015, the whole content of these two applications being incorporated herein by reference for all purposes.

TECHNICAL FIELD

The present invention relates to a method for preparing a composition comprising a quaternary ammonium compound, a cationic polysaccharide, a fragrance material or perfume, a nonionic surfactant, and optionally a nonionic polysaccharide. The composition may notably be used for fabric conditioning.

BACKGROUND ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Fabric conditioning compositions can be added in the rinse cycle of the laundering process to soften fabrics and to impart them nice smell. Conventionally, fabric conditioning systems are based on quaternary ammonium compounds, also named as quats, notably cetrimonium chloride, behentrimonium chloride, N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2-hydroxyethyl) N-methyl ammonium methylsulfate or 1,2-di(stearoyl-oxy)-3-trimethyl ammoniumpropane chloride.

However, quats are known difficult to be bio-degraded and thus exhibit eco toxicity. There is a general trend in the industry to switch to other conditioning systems. One option is to use ester quats which provide better biodegradability and lower eco toxicity. Nevertheless, one problem associated with the ester quats is that the stability of such compounds is not satisfactory, particularly when the ester quats are present at high levels in the fabric conditioning composition, which may be attributed to its biodegradable nature.

On the other hand, fragrance material or perfume is often incorporated into the fabric conditioning composition to provide a pleasant odour to fabrics laundered. Such fragrance material or perfume generally exists as oil droplets in the fabric conditioning composition. One problem is that the oil droplets of the fragrance material or perfume may not remain stable in the composition and may phase separate from other components of the composition, especially when the fragrance material or perfume is present in high amount. In such case, the ability of perfume delivery of the composition would be jeopardized and the composition would not have satisfactory visual appearance. There is a need to provide compositions which stably incorporate the fragrance material or perfume. There is also a need to provide compositions in which the fragrance material or perfume incorporated can have long-lasting odour and the odour can be slowly emitted from the substrate (such as the fabric). This property is often described as substantivity, tenacity or longevity of the fragrance material or perfume. There is also a need to provide stable composition which can provide perfume longevity in combination with excellent softening performance.

SUMMARY OF INVENTION

It has been found that the above problems can be solved by the present invention.

In a first aspect of the present invention, there is provided a method for preparing a composition comprising the steps of:

(1) providing a mixture of a quaternary ammonium compound, a cationic polysaccharide, and optionally a nonionic polysaccharide (Component A):

(2) providing a mixture of a fragrance material or perfume and a nonionic surfactant (Component B);

(3) mixing Component A and Component B.

In one embodiment, Component A comprises the quaternary ammonium compound, the cationic polysaccharide, and the nonionic polysaccharide.

In another embodiment, step (1) comprises the steps of (i) mixing the cationic polysaccharide and the nonionic polysaccharide;

(ii) mixing the quaternary ammonium compound with the mixture of (i).

In still another embodiment, step (i) is mixing the cationic polysaccharide, the nonionic polysaccharide and water.

In still another embodiment, the pH value of the mixture of step (i) is adjusted to be in the range of 3.5 to 5.

In still another embodiment, the cationic polysaccharide is a cationic guar.

In still another embodiment, the nonionic polysaccharide is a nonionic guar.

In still another embodiment, the nonionic surfactant is an alkoxylated compound.

In a second aspect of the present invention, there is provided a composition obtained according to the first aspect of the present invention.

In a third aspect of the present invention, there is provided a composition comprising:

(a) from 0.5 wt % to 45 wt % of a quaternary ammonium compound;

(b) from 0.01 wt % to 10 wt % of a fragrance material or perfume;

(c) from 0.1 wt % to 5 wt % of a nonionic surfactant;

(d) from 0.05 wt % to 10 wt % of a cationic polysaccharide;

(e) from 0.05 wt % to 10 wt % of a nonionic polysaccharide; and (f) water;

the weight percentage is based on the total weight of the composition.

In one embodiment, the composition comprises:

(a) from 0.5 wt % to 45 wt % of a quaternary ammonium compound;

(b) from 0.3 wt % to 10 wt % of a fragrance material or perfume;

(c) from 0.1 wt % to 5 wt % of a nonionic surfactant;

(d) from 0.05 wt % to 10 wt % of a cationic polysaccharide;

(e) from 0.05 wt % to 10 wt % of a nonionic polysaccharide; and (f) water;

the weight percentage is based on the total weight of the composition.

In another embodiment, the composition comprises:

(a) from 0.5 wt % to 45 wt % of a quaternary ammonium compound;

(b) from 0.6 wt % to 10 wt % of a fragrance material or perfume;
(c) from 0.1 wt % to 5 wt % of a nonionic surfactant;
(d) from 0.05 wt % to 10 wt % of a cationic polysaccharide;
(e) from 0.05 wt % to 10 wt % of a nonionic polysaccharide; and
(f) water;
the weight percentage is based on the total weight of the composition.

In still another embodiment, the composition comprises:
(a) from 0.5 wt % to 20 wt % of a quaternary ammonium compound;
(b) from 0.1 wt % to 5 wt % of a fragrance material or perfume;
(c) from 0.2 wt % to 4 wt % of a nonionic surfactant;
(d) from 0.05 wt % to 5 wt % of a cationic polysaccharide;
(e) from 0.05 wt % to 5 wt % of a nonionic polysaccharide; and
(f) water;
the weight percentage is based on the total weight of the composition.

In still another embodiment, the composition comprises:
(a) from 0.5 wt % to 20 wt % of a quaternary ammonium compound;
(b) from 0.6 wt % to 5 wt % of a fragrance material or perfume;
(c) from 0.2 wt % to 4 wt % of a nonionic surfactant;
(d) from 0.05 wt % to 5 wt % of a cationic polysaccharide;
(e) from 0.05 wt % to 5 wt % of a nonionic polysaccharide; and
(f) water;
the weight percentage is based on the total weight of the composition.

In a fourth aspect of the present invention, there is provided a method for conditioning a fabric by using the composition according to the second or the third aspect of the present invention.

DETAILED DESCRIPTION

Throughout the description, including the claims, the term "comprising one" or "comprising a" should be understood as being synonymous with the term "comprising at least one", unless otherwise specified, and "between" should be understood as being inclusive of the limits.

In the context of this invention, "textile care agent" is understood to mean both washing and cleaning agents and pretreatment agents, as well as agents for conditioning textile fabrics such as delicate fabric washing agents, and post-treatment agents such as conditioners.

In the context of this invention, the term "fabric conditioning" is used herein the broadest sense to include any conditioning benefit(s) to textile fabrics, materials, yarns, and woven fabrics. One such conditioning benefit is softening fabrics. Other non-limiting conditioning benefits include fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency; refreshing, anti-microbial, odor resistance; perfume freshness, perfume longevity, and mixtures thereof.

"Alkyl" as used herein means a straight chain or branched saturated aliphatic hydrocarbon group and is intended to include both "unsubstituted alkyl" and "substituted alkyl", the latter of which refers to alkyl moieties having substituents (such as hydroxyl group and halogen group) replacing a hydrogen on one or more carbon atoms of the alkyl group. "Alkenyl", as used herein, refers to an aliphatic group containing at least one double bond and is intended to include both "unsubstituted alkenyls" and "substituted alkenyls", the latter of which refers to alkenyl moieties having substituents (such as hydroxyl group and halogen group) replacing a hydrogen on one or more carbon atoms of the alkenyl group.

The term "cationic polymer" as used herein means any polymer which has a cationic charge.

The term "quaternary ammonium compound" (also referred to as "quat") as used herein means a compound containing at least one quaternized nitrogen wherein the nitrogen atom is attached to four organic groups. The quaternary ammonium compound may comprise one or more quaternized nitrogen atoms.

The term "cationic polysaccharide" as used herein means a polysaccharide or a derivative thereof that has been chemically modified to provide the polysaccharide or the derivative thereof with a net positive charge in a pH neutral aqueous medium. The cationic polysaccharide may also include those that are non permanently charged, e.g. a derivative that can be cationic below a given pH and neutral above that pH. Non-modified polysaccharides, such as starch, cellulose, pectin, carageenan, guars, xanthans, dextrans, curdlans, chitosan, chitin, and the like, can be chemically modified to impart cationic charges thereon. A common chemical modification incorporates quaternary ammonium substituents to the polysaccharide backbones. Other suitable cationic substituents include primary, secondary or tertiary amino groups or quaternary sulfonium or phosphinium groups. Additional chemical modifications may include cross-linking, stabilization reactions (such as alkylation and esterification), phophorylations, hydrolyzations.

The term "nonionic polysaccharide" as used herein refers to a polysaccharide or a derivative thereof that has been chemically modified to provide the polysaccharide or the derivative thereof with a net neutral charge in a pH neutral aqueous medium; or a non-modified polysaccharide.

In a first aspect of the present invention, there is provided a method for preparing a composition, such as a fabric conditioning composition, comprising the steps of:
(1) providing a mixture of a quaternary ammonium compound, a cationic polysaccharide, and optionally a nonionic polysaccharide (Component A):
(2) providing a mixture of a fragrance material or perfume and a nonionic surfactant (Component B);
(3) mixing Component A and Component B.

Notably, the present invention provides a method for preparing a composition, such as a fabric conditioning composition, comprising the steps of:
(1) providing a mixture of a quaternary ammonium compound, a cationic polysaccharide, and a nonionic polysaccharide (Component A):
(2) providing a mixture of a fragrance material or perfume and a nonionic surfactant (Component B);
(3) mixing Component A and Component B.

Preferably, water is also added in step (1), accordingly, Component A is prepared as a suspension in water.

It has been found that addition of the premix of the fragrance material or perfume and the nonionic surfactant can lead to enhanced stability of the resulting composition in comparison to those that comprise a fragrance material or perfume and do not comprise a nonionic surfactant. As a result, the fragrance material or perfume in the composition would not phase separate from other components for an extended time period.

It is appreciated that the mixing steps in the methods described herein may be conducted in any mixing apparatus or container known by a person skilled in the art. Preferably, heating and/agitation are provided to speed up the mixing. Heating and agitation can be provided by using conventional apparatus. The mixing may be stopped when a homogenous mixture of the different components is formed.

According to the present invention, Step (1) as described herein may comprise the steps of:

(i) mixing a cationic polysaccharide and a nonionic polysaccharide;

(ii) mixing a quaternary ammonium compound with the mixture of (i).

Preferably, water is added in step (i) to provide an aqueous dispersion of the cationic polysaccharide and the nonionic polysaccharide. Agitation and/or heating may also be provided to facilitate the process. In one preferred embodiment, the pH value of the aqueous dispersion of the cationic polysaccharide and the nonionic polysaccharide is adjusted to be in the range of 3.5 to 5 by using an acidic agent. Such pH adjustment may be conducted before the dispersion being heated. In step (ii), the quaternary ammonium compound may be heated to a temperature above the melting point of the quaternary ammonium compound for melting it before mixing the same with the mixture of (i). Generally a temperature of from 30° C. to 85° C. is sufficient for melting the quaternary ammonium compound. Some quaternary ammonium compounds are in liquid form under ambient temperature, in such case, they can be directly mixed with the mixture of (i). Preferably, agitation and/or heating is provided to speed up the mixing of the quaternary ammonium compound and the mixture of (i). Also, Component A is preferably cooled to a temperature below 35° C. before mixing it with Component B so as to avoid jeopardizing the fragrance material or perfume contained in Component B.

Referring to step (2), the fragrance material or perfume and the nonionic surfactant may be conveniently mixed by adding either of the component to the other as these materials are generally in liquid form. Certain nonionic surfactant is in solid form or semi-solid form under ambient temperature. In such case, the nonionic surfactant can be heated for melting it before the mixing. In one preferred embodiment, the ratio of the weight of the fragrance material or perfume to the weight of the nonionic surfactant is in the range of from 1:5 to 10:1.

Referring to step (3), the mixing of component A and Component B can be done by adding either component to the other. Water may be added to adjust the concentration of the components. Preferably, after the mixing of Component A and Component B, the pH value of the resulting mixture is adjusted to be in the range of 2.5 to 8, by using a suitable acidic agent or basic agent.

Quaternary Ammonium Compound

According to the present invention, the quaternary ammonium compound may have the general formula (I):

$$[N^+(R_1)(R_2)(R_3)(R_4)]_yX^- \quad (I)$$

wherein:

$R_1$, $R_2$, $R_3$ and $R_4$, which may be the same or different, is a $C_1$-$C_{30}$ hydrocarbon group, typically an alkyl, hydroxyalkyl or ethoxylated alkyl group, optionally containing a heteroatom or an ester or amide group;

X is an anion, for example halide, such as Cl or Br, sulphate, alkyl sulphate, nitrate or acetate;

y is the valence of X.

In one embodiment, the quaternary ammonium compound is an alkyl quat, such as a di-alkyl quat. Alternatively, the quaternary ammonium compound is an ester quat such as a di-alkyl di-ester quat.

The di-alkyl quat may be a compound of general formula (II):

$$[N^+(R_5)_2(R_6)(R_7)]_yX^- \quad (II)$$

wherein:

$R_5$ is an aliphatic $C_{16-22}$ group;

$R_6$ is a $C_1$-$C_3$ alkyl group;

$R_7$ is $R_5$ or $R_6$;

X is an anion, for example halide, such as Cl or Br, sulphate, alkyl sulphate, nitrate or acetate;

y is the valence of X.

The di-alkyl quat is preferably dihydrogenated tallow dimethyl ammonium chloride.

In another embodiment, the quaternary ammonium compound is an ester quat having the general formula (III):

$$[N^+((CH_2)_n\text{-}T\text{-}R_8)_m(R_9)_{4-m}]_yX^- \quad (III)$$

wherein:

$R_8$ group is independently selected from $C_1$-$C_{30}$ alkyl or alkenyl group;

$R_9$ group is independently selected from $C_1$-$C_4$ alkyl or hydroxylalkyl group;

T is —C(═O)—O— or —O—C(═O)—;

n is an integer from 0 to 5;

m is selected from 1, 2 and 3;

X is an anion, for example a chloride, bromide, nitrate or methosulphate ion;

y is the valence of X.

Preferably, m as defined in general formula (III) is 2. Accordingly, the quaternary ammonium compound has the general formula of (IV):

$$[N^+((CH_2)_n\text{-}T\text{-}R_8)_2(R_9)_2]_yX^- \quad (IV)$$

wherein $R_8$, $R_9$, T, n, y and X are as defined in general formula (III).

It is appreciated that in the general formula of (III) and (IV), T may also be —$NR_{10}$—C(═O)— or —(C═O)—$NR_{10}$—, wherein $R_{10}$ is hydrogen, a $C_1$-$C_6$ alkyl or a $C_1$-$C_6$ hydroxyalkyl group.

Preferably, the average chain length of the alkyl or alkenyl group is at least $C_{14}$, more preferably at least $C_{16}$. Even more preferably at least half of the chains have a length of $C_{18}$. The fatty acid chains of the ester quat may comprise from 20 to 35 weight percent of saturated $C_{18}$ chains and from 20 to 35 weight percent of monounsaturated $C_{18}$ chains by weight of total fatty acid chains. Preferably, the ester quat is derived from palm or tallow feedstocks. These feedstocks may be pure or predominantly palm or tallow based. Blends of different feedstocks may be used. In one embodiment, the fatty acid chains of the ester quat comprise from 25 to 30 weight percent, preferably from 26 to 28 weight percent of saturated $C_{18}$ chains and from 25 to 30 weight percent, preferably from 26 to 28 weight percent of monounsaturated $C_{18}$ chains, by weight of total fatty acid chains. In another embodiment, the fatty acid chains of the ester quat comprise from 30 to 35 weight percent, preferably from 33 to 35 weight percent of saturated $C_{18}$ chains and from 24 to 35 weight percent, preferably from 27 to 32 weight percent of monounsaturated $C_{18}$ chains, by weight of total fatty acid chains. The alkyl or alkenyl chains may be predominantly linear, although a degree of branching, especially mid-chain branching, is within the scope of the invention.

In still another embodiment, the ester quaternary ammonium compound is triethanolamine-based quaternary ammonium of general formula (V):

$$[N^+(C_2H_4—OOCR_{11})_2(CH_3)(C_2H_4—OH)](CH_3)_zSO_4^- \quad (V)$$

wherein $R_{11}$ is a $C_{12}$-$C_{20}$ alkyl group;
z is an integer from 1 to 3.

The quaternary ammonium compound of the present invention may also be a mixture of various quaternary ammonium compounds, notably for instance a mixture of mono-, di- and tri-ester components or a mixture of mono-, and di-ester components, wherein for instance the amount of diester quaternary is comprised between 30 and 99% by weight based on the total amount of the quaternary ammonium compound.

Preferably, the quaternary ammonium compound is a mixture of mono-, di- and tri-ester components, wherein:

- the amount of di-ester quaternary is comprised between 30 and 70% by weight based on the total amount of the quaternary ammonium compound, preferably between 40 and 60% by weight,
- the amount of mono-ester quaternary is comprised between 10 and 60% by weight based on the total amount of the quaternary ammonium compound, preferably between 20 and 50% by weight,
- the amount of tri-ester quaternary is comprised between 1 and 20% by weight based on the total amount of the quaternary ammonium compound.

Alternatively, the quaternary ammonium compound is a mixture of mono- and di-ester components, wherein:

- the amount of di-ester quaternary is comprised between 30 and 99% by weight based on the total amount of the quaternary ammonium compound, preferably between 50 and 99 by weight,
- the amount of mono-ester quaternary is comprised between 1 and 50% by weight based on the total amount of the quaternary ammonium compound, preferably between 1 and 20% by weight.

Preferred ester quaternary ammonium compounds of the present invention include:

TET: Di(tallowcarboxyethyl)hydroxyethyl methyl ammonium methylsulfate,

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, TEP: Di(palmiticcarboxyethyl)hydroxyethyl methyl ammonium methylsulfate, DEEDMAC: Dimethylbis[2-[(1-oxooctadecyl)oxy]ethyl] ammonium chloride.

In one exemplary embodiment, the quaternary ammonium compound is bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 60, and from 0.5 to 5% by weight fatty acid. Preferably, the bis-(2-hydroxypropyl)-dimethylammonium methylsulphate fatty acid ester is a mixture of at least one di-ester of formula:

$$[(CH_3)_2N^+(CH_2CH(CH_3)OC(=O)R_{12})_2]CH_3SO_4^- \quad (VI)$$

and at least one mono-ester of formula:

$$[(CH_3)_2N^+(CH_2CH(CH_3)OH)(CH_2CH(CH_3)OC(=O)R_{12})]CH_3SO_4^- \quad (VII)$$

wherein $R_{12}$ is the hydrocarbon group of a fatty acid moiety $R_{12}COO$—. Notably, such bis-(2-hydroxypropyl)-dimethylammonium methylsulphate fatty acid ester has a molar ratio of fatty acid moieties to amine moieties of from 1.85 to 1.99, the fatty acid moiety has an average chain length of from 16 to 18 carbon atoms and an iodine value, calculated for the free fatty acid, of from 0.5 to 60, preferably from 0.5 to 50. The average chain length is preferably from 16.5 to 17.8 carbon atoms. The iodine value is preferably from 5 to 40, more preferably, from 15 to 35. The iodine value is the amount of iodine in g consumed by the reaction of the double bonds of 100 g of fatty acid, which may notably be determined by the method of ISO 3961. In order to provide the required average chain length and iodine value, the fatty acid moiety may be derived from a mixture of fatty acids comprising both saturated and unsaturated fatty acids.

In another exemplary embodiment, the quaternary ammonium compound is a compound of the general formula:

(VIII)

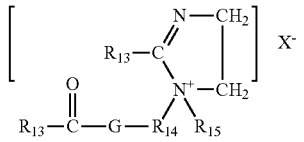

wherein $R_{15}$ is either hydrogen, a short chain $C_1$-$C_6$, preferably $C_1$-$C_3$ alkyl or hydroxyalkyl group, e.g. methyl, ethyl, propyl, hydroxyethyl, and the like, poly($C_2$-$C_3$ alkowy), preferably polyethoxy, benzyl, or mixtures thereof;

$R_{13}$ is a hydrocarbyl, or substituted hydrocarbyl group;

$X^-$ have the definitions given above;

$R_{14}$ is a $C_1$-$C_6$ alkylene group, preferably an ethylene group; and

G is an oxygen atom, or an —$NR_{10}$— group wherein $R_{10}$ is as defined above.

A non-limiting example of compound (VIII) is 1-methyl-1-stearoylamidoethyl-2-stearoylimidazolinium methylsulfate.

In still another exemplary embodiment, the quaternary ammonium compound is a compound of the general formula:

(IX)

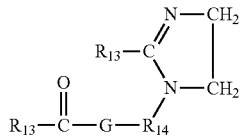

wherein $R_{13}$, $R_{14}$ and G are defined as above.

A non-limiting example of compound (IX) is I-tallowylamidoethyl-2-tallowylimidazoline.

In still another exemplary embodiment, the quaternary ammonium compound is a compound of the general formula:

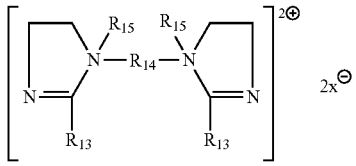

(X)

wherein $R_{13}$, $R_{14}$ and $R_{15}$ are defined as above.

A non-limiting example of compound (X) is

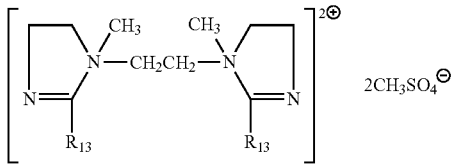

(XI)

wherein $R_{13}$ is defined as above.

In one embodiment, the quaternary ammonium compound is present in an amount of from 0.5 to 45 wt % based on the total weight of the composition. In another embodiment, the quaternary ammonium compound is present in an amount of from 0.5 to 20 wt % based on the total weight of the composition. In still another embodiment, the quaternary ammonium compound is present in an amount of from 0.5 to 10 wt % based on the total weight of the composition. In still another embodiment, the quaternary ammonium compound is present in an amount of from 1 to 10 wt % based on the total weight of the composition. In still another embodiment, the quaternary ammonium compound is present in an amount of from 3 to 8 wt % based on the total weight of the composition.

Cationic Polysaccharide

According to the present invention, Component A comprises at least one cationic polysaccharide. In one embodiment, Component A comprises only one cationic polysaccharide. In another embodiment, Component A comprises a mixture of more than one cationic polysaccharides.

The cationic polysaccharide can be obtained by chemically modifying polysaccharides, generally natural polysaccharides. By such modification, cationic side groups can be introduced into the polysaccharide backbone. In one embodiment, the cationic groups borne by the cationic polysaccharide according to the present invention are quaternary ammonium groups.

The cationic polysaccharides of the present invention include but are not limited to:

cationic guar and derivatives thereof, cationic cellulose and derivatives thereof, cationic starch and derivatives thereof, cationic callose and derivatives thereof, cationic xylan and derivatives thereof, cationic mannan and derivatives thereof, cationic galactomannose and derivative thereof.

Cationic celluloses suitable for the present invention include cellulose ethers comprising quaternary ammonium groups, cationic cellulose copolymers or celluloses grafted with a water-soluble quaternary ammonium monomer.

The cellulose ethers comprising quaternary ammonium groups are described in French patent 1,492,597 and in particular include the polymers sold under the names "JR" (JR 400, JR 125, JR 30M) or "LR" (LR 400, LR 30M) by the company Dow. These polymers are also defined in the CTFA dictionary as hydroxyethylcellulose quaternary ammoniums that have reacted with an epoxide substituted with a trimethylammonium group. Suitable cationic celluloses also include LR3000 KC from company Solvay.

The cationic cellulose copolymers or the celluloses grafted with a water-soluble quaternary ammonium monomer are described especially in U.S. Pat. No. 4,131,576, such as hydroxyalkylcelluloses, for instance hydroxymethyl-, hydroxyethyl- or hydroxypropylcelluloses grafted especially with a methacryloyl-ethyltrimethylammonium, methacrylamidopropyltrimethylammonium or dimethyl-diallylammonium salt. The commercial products corresponding to this definition are more particularly the products sold under the names Celquat® L 200 and Celquat® H 100 by the company Akzo Nobel.

Cationic starches suitable for the present invention include the products sold under Polygelo® (cationic starches from Sigma), the products sold under Softgel®, Amylofax® and Solvitose® (cationic starches from Avebe), CATO from National Starch.

Suitable cationic galactomannose include, for example, Fenugreek Gum, Konjac Gum, Tara Gum, Cassia Gum.

In one embodiment, the cationic polysaccharide is a cationic guar. Guars are polysaccharides composed of the sugars galactose and mannose. The backbone is a linear chain of β1,4-linked mannose residues to which galactose residues are 1,6-linked at every second mannose, forming short side-branches. Within the context of the present invention, the cationic guars are cationic derivatives of guars.

In the case of the cationic polysaccharide, such as the cationic guar, the cationic group may be a quaternary ammonium group bearing 3 radicals, which may be identical or different, preferably chosen from hydrogen, alkyl, hydroxyalkyl, epoxyalkyl, alkenyl, or aryl, preferably containing 1 to 22 carbon atoms, more particularly 1 to 14 and advantageously 1 to 3 carbon atoms. The counterion is generally a halogen. One example of the halogen is chlorine.

Examples of the quaternary ammonium group include: 3-chloro-2-hydroxypropyl trimethyl ammonium chloride (CHPTMAC), 2,3-epoxypropyl trimethyl ammonium chloride (EPTAC), diallyldimethyl ammonium chloride (DMDAAC), vinylbenzene trimethyl ammonium chloride, trimethylammonium ethyl metacrylate chloride, methacrylamidopropyltrimethyl ammonium chloride (MAPTAC), and tetraalkylammonium chloride.

One example of the cationic functional group in the cationic polysaccharides, such as the cationic guars, is trimethylamino(2-hydroxyl)propyl, with a counter ion. Various counter ions can be utilized, including but not limited to halides, such as chloride, fluoride, bromide, and iodide, sulfate, notrate, methylsulfate, and mixtures thereof.

The cationic guars of the present invention may be chosen from the group consisting of:

cationic hydroxyalkyl guars, such as cationic hydroxyethyl guar, cationic hydroxypropyl guar, cationic hydroxybutyl guar, and cationic carboxylalkyl guars including cationic carboxymethyl guar, cationic alkylcarboxy guars such as cationic carboxylpropyl guar and cationic carboxybutyl guar, cationic carboxymethylhydroxypropyl guar.

In one embodiment, the cationic guars of the present invention are guars hydroxypropyltrimonium chloride or hydroxypropyl guar hydroxypropyltrimonium chloride.

The cationic polysaccharide, such as the cationic guars, of the present invention may have an average Molecular Weight (Mw) of between 100,000 daltons and 3,500,000 daltons, preferably between 100,000 daltons and 1,500,000 daltons, more preferably between 100,000 daltons and 1,000,000 daltons.

In one embodiment, the composition comprises from 0.05 to 10 wt % of the cationic polysaccharide based on the total weight of the composition. In another embodiment, the composition comprises from 0.05 to 5 wt % of the cationic polysaccharide based on the total weight of the composition. In still another embodiment, the composition comprises from 0.2 to 2 wt % of the cationic polysaccharide based on the total weight of the composition.

In the context of the present application, the term "Degree of Substitution (DS)" of cationic polysaccharides, such as cationic guars, is the average number of hydroxyl groups substituted per sugar unit. DS may notably represent the number of the carboxymethyl groups per sugar unit. DS may be determined by titration.

In one embodiment, the DS of the cationic polysaccharide, such as the cationic guar, is in the range of 0.01 to 1. In another embodiment, the DS of the cationic polysaccharide, such as the cationic guar, is in the range of 0.05 to 1. In still another embodiment, the DS of the cationic polysaccharide, such as the cationic guar, is in the range of 0.05 to 0.2.

In the context of the present application, "Charge Density (CD)" of cationic polysaccharides, such as cationic guars, means the ratio of the number of positive charges on a monomeric unit of which a polymer is comprised to the molecular weight of said monomeric unit.

In one embodiment, the CD of the cationic polysaccharide, such as the cationic guar, is in the range of 0.1 to 3 (meq/gm). In another embodiment, the CD of the cationic polysaccharide, such as the cationic guar, is in the range of 0.1 to 2 (meq/gm). In still another embodiment, the CD of the cationic polysaccharide, such as the cationic guar, is in the range of 0.1 to 1 (meq/gm).

Fragrance Material or Perfume

According to the present invention, Component B comprises a fragrance material or perfume.

As used herein, the term "fragrance material or perfume" means any organic substance or composition which has a desired olfactory property and is essentially non-toxic. Such substances or compositions include all fragrance material and perfumes that are commonly used in perfumery or in household compositions (laundry detergents, fabric conditioning compositions, soaps, all-purpose cleaners, bathroom cleaners, floor cleaners) or personal care compositions. The compounds involved may be natural, semi-synthetic or synthetic in origin.

Preferred fragrance materials and perfumes may be assigned to the classes of substance comprising the hydrocarbons, aldehydes or esters. The fragrances and perfumes also include natural extracts and/or essences, which may comprise complex mixtures of constituents, i.e. fruits such as almond, apple, cherry, grape, pear, pineapple, orange, lemon, strawberry, raspberry and the like; musk, flower scents such as lavender, jasmine, lily, magnolia, rose, iris, carnation and the like; herbal scents such as rosemary, thyme, sage and the like; woodland scents such as pine, spruce, cedar and the like.

Non limitative examples of synthetic and semi-synthetic fragrance materials and perfumes are:

7-acetyl-1,2,3,4,5,6,7,8-octahydro-1,1,6,7-tetramethylnaphthalene, α-ionone, β-ionone, γ-ionone, α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl b-naphthyl ketone, 6-acetyl-1,1,2,3,3,5-hexamethylindane, 5-acetyl-3-isopropyl-1,1,2,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl)propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethylcyclopenta-g-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

Particular preference is given to the following: hexylcinnamaldehyde, 2-methyl-3-(tert-butylphenyl)propionaldehyde, 7-acetyl-1,2,3,4,5,6,7,8-octahydro-1,1,6,7-tetramethylnaphthalene, benzyl salicylate, 7-acetyl-1,1,3,4,4,6-hexamethyltetralin, para-tert-butylcyclohexyl acetate, methyl dihydrojasmonate, (β-naphthol methyl ether, methyl g-naphthyl ketone, 2-methyl-2-(para-isopropylphenyl)propionaldehyde, 1,3,4,6,7,8-hexahydro-4,6,6,7,8,8-hexamethylcyclopenta-g-2-benzopyran, dodecahydro-3a,6,6,9a-tetramethylnaphtho[2,1b]furan, anisaldehyde, coumarin, cedrol, vanillin, cyclopentadecanolide, tricyclodecenyl acetate and tricyclodecenyl propionates.

Other fragrance materials and perfumes are essential oils, resinoids and resins from a large number of sources, such as, Peru balsam, olibanum resinoid, styrax, labdanum resin, nutmeg, cassia oil, benzoin resin, coriander, clary sage, eucalyptus, geranium, lavender, mace extract, neroli, nutmeg, spearmint, sweet violet leaf, valerian and lavandin.

Some or all of the fragrance materials and perfumes may be encapsulated, typical perfume components which it is advantageous to encapsulate, include those with a relatively low boiling point. It is also advantageous to encapsulate perfume components which have a low C log P (i.e. those which will be partitioned into water), preferably with a C log P of less than 3.0. As used herein, the term "C log P" means the calculated logarithm to base 10 of the octanol/water partition coefficient (P).

Further suitable fragrance materials and perfumes include: phenylethyl alcohol, terpineol, linalool, linalyl acetate, geraniol, nerol, 2-(1,1-dimethylethyl)cyclo-hexanol acetate, benzyl acetate, and eugenol.

The fragrance material or perfume can be used as single substance or in a mixture with one another.

Perfumes frequently include solvents or diluents, for example: ethanol, isopropanol, diethylene glycol monoethyl ether, dipropylene glycol, diethyl phthalate and triethyl citrate.

In one embodiment, the composition comprises from 0.01 to 10 wt % of the fragrance material or perfume based on the total weight of the composition. In another embodiment, the composition comprises from 0.3 to 10 wt % of the fragrance material or perfume based on the total weight of the composition. In still another embodiment, the composition comprises from 0.6 to 10 wt % of the fragrance material or perfume based on the total weight of the composition. In still another embodiment, the composition comprises from 0.1 to 5 wt % of the fragrance material or perfume based on the total weight of the composition, preferably, from 0.6 to 5 wt %. In still another embodiment, the composition comprises from 0.1 to 2 wt % of the fragrance material or perfume based on the total weight of the composition, preferably from 0.6 to 2 wt %. It is appreciated that the composition of the present invention may notably comprise 0.6 wt %, 0.7 wt %, 0.8 wt %, 0.9 wt %, 1 wt %, 1.2 wt %, 1.4 wt %, 1.6 wt %, 1.8 wt %, 2.0 wt % of the fragrance material or perfume based on the total weight of the composition (and all values and subranges between stated values as if explicitly written out). In particular, the composition comprises 0.6 wt % or 1.0 wt % of the fragrance material or perfume based on the total weight of the composition.

Nonionic Surfactant

According to the present invention, Component B comprises at least one nonionic surfactant. Preferably, the nonionic surfactant is an alkoxylated compound. The nonionic surfactant may comprise an average of from 2 to 100 moles of alkylene oxide per mole of the nonionic surfactant. This is referred to herein as the alkoxylation number (of the nonionic surfactant).

The nonionic surfactant acts to stabilize the fragrance material or perfume in the composition, such that the composition can have enhanced stability, and enhanced perfume longevity as well.

Suitable nonionic surfactants include addition products of ethylene oxide and/or propylene oxide with fatty alcohols, fatty acids, fatty amines and fatty oils.

Any of the alkoxylated compounds of the particular type described hereinafter can be used as the nonionic surfactant.

Suitable surfactants are substantially water soluble surfactants of the general formula: $R—Y—(C_2H_4O)_z—C_2H_4OH$ where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms. R may also be mono-, di-, or tri-alkyl glycerides with hydroxyl group as side group in each of the alkyl chains, for example, castor oil or hydrogenated castor oil. R may also be alkyl Sorbitan esters, with the carbon chain length of from 8 to 25.

In the general formula for the ethoxylated nonionic surfactant, Y is typically: —O—, —C(O)O—, —C(O)N(R)—, or —C(O)N(R)R—; wherein R has the meaning given above or can be hydrogen; and Z is at least 1, preferably from 10 to 50. Preferably the nonionic surfactant has an HLB of from 3 to 20, more preferably from 10 to 18, e.g. 12 to 16.

Examples of nonionic surfactants are as follows. In the examples, the integer defines the number of ethoxy (EO) groups in the molecule.

(a) Straight-Chain, Primary Alcohol Alkoxylates

Examples are the deca-, undeca-, dodeca-, tetradeca-, and pentadecaethoxylates of n-hexadecanol, and n-octadecanol having an HLB within the range recited herein. The ethoxylates of mixed natural or synthetic alcohols in the "tallow" chain length range are also useful herein. Specific examples of such materials include tallow alcohol-EO(11), tallow alcohol-EO(18), and tallow alcohol-EO (25).

(b) Straight-Chain, Secondary Alcohol Alkoxylates

Examples are the deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein.

(c) Alkyl Phenol Alkoxylates

As in the case of the alcohol alkoxylates, examples are the hexa- to octadeca-ethoxylates of alkylated phenols, particularly monohydric alkylphenols, having an HLB within the range recited herein. The hexa- to octadeca-ethoxylates of p-tri-decylphenol, m-pentadecylphenol, and the like, are useful herein.

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(d) Olefinic Alkoxylates

Examples are the alkenyl alcohols, both primary and secondary, and alkenyl phenols corresponding to those disclosed immediately hereinabove can be ethoxylated to an HLB within the range recited herein.

(e) Branched Chain Alkoxylates

Branched chain primary and secondary alcohols which are available from the well-known "OXO" process can be ethoxylated and employed. The average alkoxylation number is from 10 to 40, more preferably from 10 to 30, most preferably from 10 to 20 (e.g. 11 to 19).

Examples of commercially available alkoxylated nonionic alcohols include: LUTENSOL® AT11 ($C_{16-18}$ fatty alcohol 11EO); LUTENSOL® A8 ($C_{12-14}$ fatty alcohol 8EO) and LUTENSOL® AT 25 ($C_{16-18}$ fatty alcohol 25EO), all ex BASF; GENAPOL® C050 (coco alcohol 5EO); GENAPOL® C100 (coco alcohol 10EO); GENAPOL® C200 (coco alcohol 20EO) and GENAPOL® T-150 (tallow alcohol 15EO), all ex Clariant; and REMCOPAL® 20, ex Elf Atochem (lauryl alcohol 19EO).

(f) Fatty Oil or Hydrogenated Fatty Oil Ethoxylates

Examples of commercially available fatty oil ethoxylates are: ALKAMULS® castor oil CRH/40C (PEG-40 hydrogenated castor oil), ALKAMULS® EL 620 (PEG-30), Super Sterol Ester (C10-30 Cholesterol/Lanosterol Esters), Aqualose™ L30 (PEG-30 Lanolin).

(g) Alkyl Sorbitan Esters Ethoxylates or Alkyl Glyceride Ethoxylates

Examples of commercially available fatty oil ethoxylates are: ALKAMULS® PSML20 (Polysorbate 20), Glycerox HE (PEG-7 Glyceryl Cocoate).

In one embodiment, the nonionic surfactant is present in an amount of from 0.1 wt % to 5 wt % based on the total weight of the composition. In another embodiment, the nonionic surfactant is present in an amount of from 0.2 wt % to 4 wt % based on the total weight of the composition.

Nonionic Polysaccharide

According to the present invention, Component A optionally comprises a nonionic polysaccharide. In a preferred embodiment, Component A comprises at least one nonionic polysaccharide. Component A may also comprise a mixture of more than one nonionic polysaccharide.

It has been found that, in accordance to the present invention, the composition which comprises the quaternary ammonium compound, the cationic polysaccharide, the fragrance material or perfume, the nonionic surfactant and the nonionic polysaccharide can provide excellent softening performance. In particular, some proportion of the quaternary ammonium compound in the composition could be reduced, by substitution with the cationic polysaccharide and the nonionic polysaccharide without any negative effect on softening performance of the composition.

It has also been found that the above mentioned composition exhibits improved fragrance/perfume performance compared to conventional compositions. Without wishing to be bound by theory, it is believed that those beneficial effects may be attributed to the synergistic effect of the cationic polysaccharide, the nonionic polysaccharide and the quaternary ammonium compound, which enhances the deposition of the fragrance material or perfume on a substrate, in particular, on a fabric, extending gradually the release of the fragrance material or perfume, enhancing the fragrance or perfume longevity (substantivity). As a result, the odour of the fragrance material or perfume can remain substantive for an extended time period on the substrate, in particular, the fabric, after the rinsing and drying (line or machine drying) steps.

The nonionic polysaccharide can be a modified nonionic polysaccharide or a non-modified nonionic polysaccharide. The modified nonionic polysaccharide may comprise hydroxyalkylations. In the context of the present application, the degree of hydroxyalkylation (molar substitution or MS) of the modified nonionic polysaccharides means the number of alkylene oxide molecules consumed by the number of free hydroxyl functions present on the polysaccharides. In one embodiment, the MS of the modified nonionic polysaccharide is in the range of 0 to 3. In another embodiment, the MS of the modified nonionic polysaccharide is in the range of 0.1 to 3. In still another embodiment, the MS of the modified nonionic polysaccharide is in the range of 0.1 to 2.

The nonionic polysaccharide of the present invention may be especially chosen from glucans, modified or non-modified starches (such as those derived, for example, from cereals, for instance wheat, corn or rice, from vegetables, for instance yellow pea, and tubers, for instance potato or cassava), amylose, amylopectin, glycogen, dextrans, celluloses and derivatives thereof (methylcelluloses, hydroxyalkylcelluloses, ethylhydroxyethylcelluloses), mannans, xylans, lignins, arabans, galactans, galacturonans, chitin, chitosans, glucuronoxylans, arabinoxylans, xyloglucans, glucomannans, pectic acids and pectins, arabinogalactans, carrageenans, agars, gum arabics, gum tragacanths, ghatti gums, karaya gums, carob gums, galactomannans such as guars and nonionic derivatives thereof (hydroxypropyl guar), and mixtures thereof.

Among the celluloses that are especially used are hydroxyethylcelluloses and hydroxypropylcelluloses. Mention may be made of the products sold under the names Klucel® EF, Klucel® H, Klucel® LHF, Klucel® MF and Klucel® G by the company Aqualon, and Cellosize® Polymer PCG-10 by the company Amerchol, and HEC, HPMC K200, HPMC K35M by the company Ashland.

In one embodiment, the nonionic polysaccharide is a nonionic guar. The nonionic guar can be modified or non-modified. The non-modified nonionic guars include the products sold under the name Vidogum® GH 175 by the company Unipectine and under the names Meypro®-Guar 50 and Jaguar® C by the company Solvay. The modified nonionic guars are especially modified with $C_1$-$C_6$ hydroxyalkyl groups. Among the hydroxyalkyl groups that may be mentioned, for example, are hydroxymethyl, hydroxyethyl, hydroxypropyl and hydroxybutyl groups. These guars are well known in the prior art and can be prepared, for example, by reacting the corresponding alkene oxides such as, for example, propylene oxides, with the guar so as to obtain a guar modified with hydroxypropyl groups.

The nonionic polysaccharide, such as the nonionic guar, of the present invention may have an average Molecular Weight (Mw) of between 100,000 daltons and 3,500,000 daltons, preferably between 500,000 daltons and 3,500,000 daltons.

In one embodiment, the composition comprise from 0.05 to 10 wt % of the nonionic polysaccharide according to the present invention based on the total weight of the composition. In another embodiment, the composition comprises from 0.05 to 5 wt % of the nonionic polysaccharide based on the total weight of the composition. In still another embodiment, the composition comprises from 0.2 to 2 wt % of the nonionic polysaccharide based on the total weight of the composition.

In one embodiment, the ratio of the weight of the quaternary ammonium compound in the composition and the total weight of the cationic polysaccharide and the nonionic polysaccharide in the composition is between 100:1 and 2:1, more preferably, between 30:1 and 5:1.

In one embodiment, the ratio of the weight of the cationic polysaccharide in the composition and the weight of the nonionic polysaccharide in the composition is between 1:10 and 10:1, more preferably, between 1:3 and 3:1.

Other Ingredients

The method of the present invention may also involve the addition of other optional ingredients. These optional ingredients are preferably added at the step of preparing Component A or added to the composition after the mixing of Component A and Component B. The optional ingredients include:

dispersing agents, stabilizers, rheology modifying agent, pH control agents, colorants, brighteners, fatty alcohols, fatty acids, dyes, odor control agent, pro-perfumes, cyclodextrins, solvents, preservatives, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, stretch resistance agents, and mixtures thereof. Such optional ingredients may be added to the composition in any desired order.

In referring to optional ingredients, without this having to be regarded as an exhaustive description of all possibilities, which, on the other hand, are well known to the person skilled in the art, the following may be mentioned:

a) other products that enhance the softening performance of the composition, such as silicones, amine oxides, anionic surfactants, such as lauryl ether sulphate or lauryl sulphate, sulphosuccinates, amphoteric surfactants, such as amphoacetate, nonionic surfactants such as polysorbate, polyglucoside derivatives, and cationic polymers such as polyquaternium, etc.;

b) products that improve viscosity control, which is preferably added when the composition comprises high concentrations of fabric conditioning active (such as the quaternary ammonium compound); for example inorganic salts, such as calcium chloride, magnesium chloride, calcium sulphate, sodium chloride, etc.; products which can be used improve the stability in concentrated compositions, such as compounds of the glycol type, such as, glycerol, polyglycerols, ethylene glycol, polyethylene glycols, dipropylene glycol, other polyglycols, etc.; and thickening agents for diluted compositions, for example, natural polymers derived from cellulose, guar, etc. or synthetic polymers, such as acrylamide based polymers (e.g. Flosoft 222 from SNF company), hydrophobically-modified ethoxylated urethanes (e.g. Acusol 880 from Dow company);

c) components for adjusting the pH, which is preferably from 2 to 8, such as any type of inorganic and/or organic acid, for example hydrochloric, sulphuric, phosphoric, citric acid etc.;

d) agents that improve soil release, such as the known polymers or copolymers based on terephthalates;

e) bactericidal preservative agents;

f) other products such as antioxidants, colouring agents, perfumes, germicides, fungicides, anti-corrosive agents, anti-crease agents, opacifiers, optical brighteners, pearl lustre agents, etc.

The composition may comprise a silicone compound. The silicone compound of the invention can be a linear or branched structured silicone polymer. The silicone of the present invention can be a single polymer or a mixture of polymers. Suitable silicone compounds include polyalkyl silicone, amonosilicone, siloxane, polydimethyl siloxane, ethoxylated organosilicone, propoxylated organosilicone, ethoxylated/propoxylated organosilicone and mixture thereof. Suitable silicones include but are not limited to those available from Wacker Chemical, such as Wacker® FC 201 and Wacker® FC 205.

The composition may comprise a cross-linking agent. Following is a non-restrictive list of cross-linking agents: methylene bisacrylamide (MBA), ethylene glycol diacrylate, polyethylene glycol dimethacrylate, diacrylamide, triallylamine, cyanomethylacrylate, vinyl oxyethylacrylate or methacrylate and formaldehyde, glyoxal, compounds of the glycidyl ether type such as ethyleneglycol diglycidyl ether, or the epoxydes or any other means familiar to the expert permitting cross-linking.

The composition may comprise a cationic and/or an amphoteric surfactant, which are commercially available from a number of sources. For a discussion of surfactants, see Kirk-Othmer, Encyclopedia of Chemical Technology, Third Edition, volume 8, pages 900-912. Preferably, the composition comprises a surfactant system in an amount effective to provide a desired level of softness to fabrics, preferably between about 5 and about 10 wt %.

The composition may comprise a dye, such as an acid dye, a hydrophobic dye, a basic dye, a reactive dye, a dye conjugate. Suitable acid dyes include azine dyes such as acid blue 98, acid violet 50, and acid blue 59, non-azine acid dyes such as acid violet 17, acid black 1 and acid blue 29. Hydrophobic dyes selected from benzodifuranes, methine, triphenylmethanes, napthalimides, pyrazole, napthoquinone, anthraquinone and mono-azo or di-azo dye chromophores. Suitable hydrophobic dyes are those dyes which do not contain any charged water solubilising group. The hydrophobic dyes may be selected from the groups of disperse and solvent dyes. Blue and violet anthraquinone and mono-azo dye are preferred. Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International. Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141. Reactive dyes are dyes which contain an organic group capable of reacting with cellulose and linking the dye to cellulose with a covalent bond. Preferably the reactive group is hydrolysed or reactive group of the dyes has been reacted with an organic species such as a polymer, so as to the link the dye to this species. Dyes may be selected from the reactive violet and reactive blue dyes listed in the Colour Index International. Preferred examples include reactive blue 19, reactive blue 163, reactive blue 182 and reactive blue, reactive blue 96. Dye conjugates are formed by binding direct, acid or basic dyes to polymers or particles via physical forces. Dependent on the choice of polymer or particle they deposit on cotton or synthetics. A description is given in WO2006/055787. Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof. The solid composition of the present invention may comprise one or more perfumes. The perfume is preferably present in an amount between 0.01 and 20 wt %, more preferably between 0.05 and 10 wt %, even more preferably between 0.05 and 5 wt %, most preferably between 0.05 and 1.5 wt %, based on the total weight of the solid composition.

The composition may comprise an antimicrobial. The antimicrobial may be a halogenated material. Suitable halogenated materials include 5-chloro-2-(2,4-dichlorophenoxy) phenol, o-Benzyl-p-chloro-phenol, and 4-chloro-3-methylphenol. Alternatively The antimicrobial may be a non-halogenated material. Suitable non-halogenated materials include 2-Phenylphenol and 2-(1-Hydroxy-1-methylethyl)-5-methylcyclohexanol. Phenyl ethers are one preferred subset of the antimicrobials. The antimicrobial may also be a bi-halogenated compound. Most preferably this comprises 4-4' dichloro-2-hydroxy diphenyl ether, and/or 2,2-dibromo-3-nitrilopropionamide (DBNPA).

The composition may also comprise preservatives. Preferably only those preservatives that have no, or only slight, skin sensitizing potential are used. Examples are phenoxy ethanol, 3-iodo-2-propynylbutyl carbamate, sodium N-(hydroxymethyl)glycinate, biphenyl-2-ol as well as mixtures thereof.

The composition may also comprise antioxidants to prevent undesirable changes caused by oxygen and other oxidative processes to the solid composition and/or to the treated textile fabrics. This class of compounds includes, for example, substituted phenols, hydroquinones, pyrocatechols, aromatic amines and vitamin E.

The composition may comprise a hydrophobic agent. The hydrophobic agent may be present in an amount of from 0.05 to 1.0 wt %, preferably from 0.1 to 0.8 wt %, more preferably from 0.2 to 0.7 and most preferably from 0.4 to 0.7 wt % by weight of the total composition, for example from 0.2 to 0.5 wt %. The hydrophobic agent may have a C log P of from 4 to 9, preferably from 4 to 7, most preferably from 5 to 7.

Suitable hydrophobic agents include esters derived from the reaction of a fatty acid with an alcohol. The fatty acid preferably has a carbon chain length of from $C_8$ to $C_{22}$ and may be saturated or unsaturated, preferably saturated. Some examples include stearic acid, palmitic acid, lauric acid and myristic acid. The alcohol may be linear, branched or cyclic. Linear or branched alcohols have a preferred carbon chain length of from 1 to 6. Preferred alcohols include methanol, ethanol, propanol, isopropanol, sorbitol. Preferred hydrophobic agents include methyl esters, ethyl esters, propyl esters, isopropyl esters and sorbitan esters derived from such fatty acids and alcohols.

Non-limiting examples of suitable hydrophobic agents include methyl esters derived from fatty acids having a carbon chain length of from at least $C_{10}$, ethyl esters derived from fatty acids having a carbon chain length of from at least $C_{10}$, propyl esters derived from fatty acids having a carbon chain length of from at least $C_8$, isopropyl esters derived from fatty acids having a carbon chain length of from at least $C_8$, sorbitan esters derived from fatty acids having a carbon chain length of from at least $C_{16}$, and alcohols with a carbon chain length greater than $C_{10}$. Naturally occurring fatty acids commonly have a carbon chain length of up to $C_{22}$.

Some preferred materials include methyl undecanoate, ethyl decanoate, propyl octanoate, isopropyl myristate, sorbitan stearate and 2-methyl undecanol, ethyl myristate, methyl myristate, methyl laurate, isopropyl palmitate and ethyl stearate; more preferably methyl undecanoate, ethyl decanoate, isopropyl myristate, sorbitan stearate, 2-methyl undecanol, ethyl myristate, methyl myristate, methyl laurate and isopropyl palmitate.

Non-limiting examples of such materials include methyl undecanoate, ethyl decanoate, propyl octanoate, isopropyl myristate, sorbitan stearate and 2-methyl undecanol; preferably methyl undecanoate, ethyl decanoate, isopropyl myristate, sorbitan stearate and 2-methyl undecanol.

The composition may comprise an antifoam agent. The antifoam agent may be present in an amount of from 0.025 to 0.45 wt %, preferably 0.03 to 0.4 wt %, most preferably from 0.05 to 0.35 wt %, for example 0.07 to 0.4 wt %, by weight of the total composition and based on 100 percent antifoam activity. A wide variety of materials may be used as the antifoam agent, and antifoam agents are well known to those skilled in the art. See, for example, Kirk Othmer Encyclopedia of Chemical Technology, Third Edition, Volume 7, pages 430-447 (John Wiley and Sons, Inc., 1979).

Suitable antifoam agents include, for example, silicone antifoam compounds, alcohol antifoam compounds, for example 2-alkyl alcanol antifoam compounds, fatty acids, paraffin antifoam compounds, and mixtures thereof. By antifoam compound it is meant herein any compound or mixtures of compounds which act such as to depress the foaming or sudsing produced by a solution of a detergent composition, particularly in the presence of agitation of that solution.

Particularly preferred antifoam agents for use herein are silicone antifoam compounds defined herein as any antifoam compound including a silicone component. Many such silicone antifoam compounds also contain a silica component. The term "silicone" as used herein, and in general throughout the industry, encompasses a variety of relatively high molecular weight polymers containing siloxane units and hydrocarbyl group of various types like the polyorganosiloxane oils, such as polydimethyl-siloxane, dispersions or emulsions of polyorganosiloxane oils or resins, and combinations of polyorganosiloxane with silica particles wherein the polyorganosiloxane is chemisorbed or fused onto the silica. Silica particles are often hydrophobed, e.g. as Trimethylsiloxysilicate. Silicone antifoam agents are well known in the art and are, for example, disclosed in U.S. Pat. No. 4,265,779, issued May 5, 25 1981 and European Patent Application No. 89307851.9, published Feb. 7, 1990. Other silicone antifoam compounds are disclosed in U.S. Pat. No. 3,455,839. Silicone defoamers and suds controlling agents in granular detergent compositions are disclosed in U.S. Pat. No. 3,933,672,35 and in U.S. Pat. No. 4,652,392 issued Mar. 24, 1987. Examples of suitable silicone antifoam compounds are the combinations of polyorganosiloxane with silica particles commercially available from Dow Corning, Wacker Chemie and Momentive.

Other suitable antifoam compounds include the monocarboxylic fatty acids and soluble salts thereof. These materials are described in U.S. Pat. No. 2,954,347. The monocarboxylic fatty acids, and salts thereof, for use as antifoam agents typically have hydrocarbyl chains of about 10 to about 24 carbon atoms, preferably about 12 to about 18 carbon atoms like the tallow amphopolycarboxyglycinate commercially available under the trade name TAPAC. Suitable salts include the alkali metal salts such as sodium, potassium, and lithium salts, and ammonium and alkanolammonium salts.

Other suitable antifoam compounds include, for example, high molecular weight hydrocarbons such as paraffin, light petroleum odourless hydrocarbons, fatty esters (e.g. fatty acid triglycerides, glyceryl derivatives, polysorbates), fatty acid esters of monovalent alcohols, aliphatic $C_{18-40}$ ketones (e.g. stearone) N-alkylated amino triazines such as tri- to hexa-10 alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl phosphates such as monostearyl alcohol phosphate ester and monostearyl di-alkali metal (e.g., K, Na, and Li) phosphates and phosphate esters, and nonionic polyhydroxyl derivatives. The hydrocarbons, such as paraffin and 15 haloparaffin, can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. Hydrocarbon suds suppressers are described, for example, in U.S. Pat. No. 4,265,779. The hydrocarbons, thus, include aliphatic, alicyclic, aromatic, and heterocyclic saturated or unsaturated hydrocarbons having from about 12 to about 70 carbon atoms. The term "paraffin", as used in this suds suppresser discussion, is intended to include mixtures of true paraffins and cyclic hydrocarbons. Copolymers of ethylene oxide and propylene oxide, particularly the mixed ethoxylated/propoxylated fatty alcohols with an alkyl chain length of from about 10 to about 16 carbon atoms, a degree of ethoxylation of from about 3 to about 30 and a degree of propoxylation of from about 1 to about 10, are also suitable antifoam compounds for use herein.

Other antifoam agents useful herein comprise the secondary alcohols (e.g., 2-alkyl alkanols as described in DE 40 21 265) and mixtures of such alcohols with silicone oils, such as the silicones disclosed in U.S. Pat. No. 4,798,679 and EP 150,872. The secondary alcohols include the $C_6$-$C_{16}$ alkyl alcohols having a $C_1$-$C_{16}$ chain like the 2-Hexyldecanol commercially available under the trade name ISOFOL 16, 2-Octyldodecanol commercially available under the tradename ISOFOL20, and 2-butyl octanol, which is available under the trademark ISOFOL 12 from Condea. A preferred alcohol is 2-butyl octanol, which is available from Condea under the trademark ISOFOL 12. Mixtures of secondary alcohols are available under the trademark ISALCHEM 123 from Enichem. Mixed antifoam agents typically comprise mixtures of alcohol to silicone at a weight ratio of about 1:5 to about 5:1. Further preferred antifoam agents are Silicone SRE grades and Silicone SE 47M, SE39, SE2, SE9 and SE10 available from Wacker Chemie; BF20+, DB310, DC1410, DC1430, 22210, HV495 and Q2-1607 ex Dow Corning; FD20P and BC2600 supplied by Basildon; and SAG 730 ex Momentive. Other suitable antifoams, described in the literature such as in Hand Book of Food Additives, ISBN 0-566-07592-X, p. 804, are selected from dimethicone, poloxamer, polypropyleneglycol, tallow derivatives, and mixtures thereof.

Preferred among the antifoam agents described above are the silicone antifoams agents, in particular the combinations of polyorganosiloxane with silica particles.

The composition may comprise an antifreeze agent. The antifreeze agent as described below is used to improve freeze recovery of the composition.

The antifreeze active may be an alkoxylated nonionic surfactant having an average alkoxylation value of from 4 to 22, preferably from 5 to 20 and most preferably from 6 to 20. The alkoxylated nonionic surfactant may have a C log P of from 3 to 6, preferably from 3.5 to 5.5. Mixtures of such nonionic surfactants may be used.

Suitable nonionic surfactants which can be used as the antifreeze agent include in particular the reaction products of compounds having a hydrophobic group and a reactive hydrogen atom, for example aliphatic alcohols, acids, or alkyl phenols with alkylene oxides, preferably ethylene oxide either alone or with propylene oxide.

Suitable antifreeze agents may also be selected from alcohols, diols and esters. A particularly preferred additional antifreeze agent is monopropylene glycol (MPG). Other nonionic antifreeze materials, which are outside the scope of the non-ionic antifreeze component of the present invention but which may be additionally included in the compositions of the invention include alkyl polyglycosides, ethoxylated castor oils, and sorbitan esters.

Further suitable antifreeze agents are those disclosed in EP 0018039 including paraffins, long chain alcohols and several esters for example glycerol mono stearate, iso butyl stearate and iso propyl palmitate. Also materials disclosed in U.S. Pat. No. 6,063,754 such as $C_{10-12}$ isoparaffins, isopropyl myristate and dioctyladapate.

The composition may comprise one or more viscosity control agents, such as polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

The composition may comprise a polymeric thickening agent. Suitable polymeric thickening agents are water soluble or dispersable. Monomers of the polymeric thickening agent may be nonionic, anionic or cationic. Following is a non-restrictive list of monomers performing a nonionic function: acrylamide, methacrylamide, N-Alkyl acrylamide, N-vinyl pyrrolidone, N-vinyl formamide, N-vinyl acetamide, vinylacetate, vinyl alcohol, acrylate esters, allyl alcohol. Following is a non-restrictive list of monomers performing an anionic function: acrylic acid, methacrylic acid, itaconic acid, crotonic acid, maleic acid, fumaric acid, as well as monomers performing a sulfonic acid or phosphonic acid functions, such as 2-acrylamido-2-methyl propane sulfonic acid (ATBS) etc. The monomers may also contain hydrophobic groups. Suitable cationic monomers are selected from the group consisting of the following monomers and derivatives and their quaternary or acid salts: dimethylaminopropylmethacrylamide, dimethylaminopropylacrylamide, diallylamine, methyldiallylamine, dialkylaminoalkyl-acrylates and methacrylates, dialkylaminoalkyl-acrylamides or -methacrylamides.

Polymeric thickening agents particularly useful in the composition of the invention include those described in WO2010/078959. These are crosslinked water swellable cationic copolymers having at least one cationic monomer and optionally other nonionic and/or anionic monomers. Preferred polymers of this type are copolymers of acrylamide and trimethylaminoethylacrylate chloride.

Preferred polymers comprise less than 25 percent of water soluble polymers by weight of the total polymer, preferably less than 20 percent, and most preferably less than 15 percent, and a cross-linking agent concentration of from 500 ppm to 5000 ppm relative to the polymer, preferably from 750 ppm to 5000 ppm, more preferably from 1000 to 4500 ppm (as determined by a suitable metering method such as that described on page 8 of patent EP 343840). The cross-linking agent concentration must be higher than about 500 ppm relative to the polymer, and preferably higher than about 750 ppm when the crosslinking agent used is the methylene bisacrylamide, or other cross-linking agents at concentrations that lead to equivalent cross-linking levels of from 10 to 10,000 ppm.

In another aspect of the present invention, there is provided a composition prepared according to the method as described herein.

The composition of the present invention may take a variety of physical forms including liquid, liquid-gel, paste-like and foam. For better dispersibility, a preferred form of the composition is an aqueous dispersion in water. When in a liquid form, the composition may also be dispensed with dispensing means such as a sprayer or aerosol dispenser. It is appreciated that the composition may also be provided in solid form, such as a powder, a particle, an agglomerate, a flake, a granule, a pellet, a tablet, a brick, a paste, a block such as a molded block, a unit dose.

In one preferred embodiment, the composition of the present invention is an aqueous fabric conditioning composition. The composition may contain from 0.1% to 20% by weight of a fabric conditioning agent (such as the quat), in the case of standard (diluted) fabric softener but may contain higher levels from up to 30% or even 45% by weight in the case of very concentrated fabric conditioning compositions. The composition may also contain other liquid carriers selected from organic solvents and mixtures thereof. Preferred organic solvents are: monohydric alcohol, such as ethanol, propanol, iso-propanol or butanol; dihydric alcohol, such as glycol; trihydric alcohols, such as glycerol, and polyhydric (polyol) alcohols.

Accordingly, in still another aspect of the present invention, there is provided a composition comprising:

(a) from 0.5 wt % to 45 wt % of a quaternary ammonium compound;

(b) from 0.01 wt % to 10 wt % of a fragrance material or perfume;

(c) from 0.1 wt % to 5 wt % of a nonionic surfactant;
(d) from 0.05 wt % to 10 wt % of a cationic polysaccharide;
(e) from 0.05 wt % to 10 wt % of a nonionic polysaccharide; and
(f) water;
the weight percentage is based on the total weight of the composition.

Preferably, the composition comprises:
(a) from 0.5 wt % to 45 wt % of a quaternary ammonium compound;
(b) from 0.3 wt % to 10 wt % of a fragrance material or perfume;
(c) from 0.1 wt % to 5 wt % of a nonionic surfactant;
(d) from 0.05 wt % to 10 wt % of a cationic polysaccharide;
(e) from 0.05 wt % to 10 wt % of a nonionic polysaccharide; and
(f) water;
the weight percentage is based on the total weight of the composition.

More preferably, the composition comprises:
(a) from 0.5 wt % to 45 wt % of a quaternary ammonium compound;
(b) from 0.6 wt % to 10 wt % of a fragrance material or perfume;
(c) from 0.1 wt % to 5 wt % of a nonionic surfactant;
(d) from 0.05 wt % to 10 wt % of a cationic polysaccharide;
(e) from 0.05 wt % to 10 wt % of a nonionic polysaccharide; and
(f) water;
the weight percentage is based on the total weight of the composition.

Notably, the composition comprises:
(a) from 0.5 wt % to 20 wt % of a quaternary ammonium compound;
(b) from 0.1 wt % to 5 wt % of a fragrance material or perfume;
(c) from 0.2 wt % to 4 wt % of a nonionic surfactant;
(d) from 0.05 wt % to 5 wt % of a cationic polysaccharide;
(e) from 0.05 wt % to 5 wt % of a nonionic polysaccharide; and
(f) water;
the weight percentage is based on the total weight of the composition.

In one preferred embodiment, the composition comprises:
(a) from 0.5 wt % to 20 wt % of a quaternary ammonium compound;
(b) from 0.6 wt % to 5 wt % of a fragrance material or perfume;
(c) from 0.2 wt % to 4 wt % of a nonionic surfactant;
(d) from 0.05 wt % to 5 wt % of a cationic polysaccharide;
(e) from 0.05 wt % to 5 wt % of a nonionic polysaccharide; and
(f) water;
the weight percentage is based on the total weight of the composition.

In still another aspect, the present invention also concerns the use of the composition according to the present invention as a textile care agent.

In still another aspect, the present invention also provides a method for conditioning a fabric comprising the step of contacting an aqueous medium containing the composition of the present invention with the fabric.

The composition of the present invention can be used in a so-called rinse process. Typically the fabric conditioning composition of the present invention is added during the rinse cycle of an automatic laundry machine (such as an automatic fabric washing machine). One aspect of the invention provides dosing the composition of the present invention during the rinse cycle of the automatic laundry washing machine. Another aspect of the invention provides for a kit comprising the composition of the present invention and optionally instructions for use.

When being used in the rinse process, the composition is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the composition may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

Accordingly, in still another aspect, there is provided a method for rinsing fabrics, which comprises the steps of contacting the fabrics, preferably previously washed in a detergent liquor, with the composition according to the present invention. The subject matter of the invention also includes the use of the composition of the present invention to impart fabric softness to fabrics; notably for fabrics that have been washed in a high suds detergent solution, while providing in the rinse a reduction of suds or foaming and without the creation of undesirable flocs.

In still another aspect, the present invention also concerns a method for softening a fabric comprising contacting an aqueous medium comprising the composition of the present invention with the fabric during a rinse cycle of a fabric washing machine.

This rinse process may be performed manually in basin or bucket, in a non-automated washing machine, or in an automated washing machine. When hand washing is performed, the laundered fabrics are removed from the detergent liquor and wrung out. The composition of the present invention may be then added to fresh water and the fabrics are then, directly or after an optional inefficient first rinse step, rinsed in the water containing the composition according to the conventional rinsing habit. The fabrics are then dried using conventional means.

In still another aspect of the present invention, there is provided a recipient containing the composition of the present invention. The recipient allows easy transportation of the composition, and distribution of the composition to users as well. The recipient of the present invention may be a tank, a bottle, a box, a tube, or the like. The recipient may be made of various materials, including and not being limited to plastic, rubber, metal, synthetic fiber, glass, ceramic material, wood and paper based material. The recipient may be in any shape which is easy for handling and transportation, including and not being limited to cubic, cuboidal, cylindrical, conical and irregular shape. The recipient preferably has at least one opening for the composition to be filled in or taken out. Preferably, the opening is on a top of the recipient. The recipient may also have a cover for closing the opening. The cover may be a lid, a cap such as a threaded cap, a sealing, a plug, a spigot, or the like.

The following examples are included to illustrate embodiments of the invention. Needless to say, the invention is not limited to the described examples.

EXAMPLES

Materials

Quat: Di(palmiticcarboxyethyl)hydroxyethyl methyl ammonium methylsulfate; Fentacare® TEP softener (from Solvay);

Nonionic Polysaccharide 1: a hydroxypropyl guar having an average Molecular Weight of between 2,000,000 and 3,000,000 daltons;

HEC: a hydroxyethyl cellulose (from Ashland);

HPMC K200: a hydroxylpropyl methyl cellulose (from Ashland);

HPMC K35M: a hydroxylpropyl methyl cellulose (from Ashland);

Cationic Polysaccharide 1: a guar hydroxypropyltrimonium chloride having an average Molecular Weight of below 1,500,000 daltons;

LR 3000KC: a quaternized cellulose (from Solvay);

LR 400: a quaternized cellulose (from Solvay);

Konjac Gum: a quaternized galactomannose (from Foodchem International Corporation);

Nonionic Surfactant 1: PEG-40 hydrogenated castor oil (from Sovlay);

Nonionic Surfactant 2: Alkamuls S20 (from Solvay);

Perfume: Fragrance Red Jewel (from Symrise).

Example 1: Effects of Addition of Nonionic Surfactant

Methods

Compositions are prepared according to the formulation in Table 1.

TABLE 1

| Formulation 1 (wt %) | |
|---|---|
| Quat | 4 (active) |
| Cationic Polysaccharide 1 | 0.2 |
| Nonionic Polysaccharide 1 | 0.2 |
| Nonionic Surfactant 1 | 0.4 |
| Perfume | 1 |
| Water | Balance to 100 |
| **Formulation 2 (wt %)** | |
| Quat | 4 (active) |
| Cationic Polysaccharide 1 | 0.2 |
| Nonionic Polysaccharide 1 | 0.2 |
| Perfume | 1 |
| Water | Balance to 100 |

Formulation 1 was prepared according to the procedure below:

1. Cationic Polysaccharide 1 and Nonionic Polysaccharide 1 were dispersed well in water with vortex;
2. HCl was added, with agitation, to adjust pH to be in the range of 4.5-5;
3. The mixture was heated to about 50° C.;
4. Quat was added to the mixture of (3) with stirring till homogeneous mixture is formed;
5. The resulting mixture was cooled down to room temperature in a water bath;
6. Nonionic Surfactant 1 and perfume were premixed and then added to formulation with stirring for 5 mins at 400 rpm.

Formulation 2 was prepared according to the same procedure as described above except that the perfume was added alone in step (6) and no nonionic surfactant was added.

Subsequently, the compositions (30 ml) were centrifuged at a speed of 6000 rpm for 30 mins. The visual appearance of the compositions was observed.

Results were shown in Table 2 below.

TABLE 2

| Formulation | Formulation 1 | Formulation 2 |
|---|---|---|
| Appearance | homogeneous | Phase separation, a top layer of the perfume occurred which was in yellow colour |

Results showed that the composition in which the perfume was pre-mixed with the nonionic surfactant exhibited excellent stability and no phase separation occurred in such composition.

Another set of compositions was prepared according to formulation shown in Table 3 below. Formulation 3 was prepared by using the method for preparing Formulation 1 as described above and Formulation 4 was prepared by using the method for preparing Formulation 2 as described above, respectively.

TABLE 3

| Formulation 3 (wt %) | |
|---|---|
| Quat | 4 (active) |
| Cationic Polysaccharide 1 | 0.2 |
| Nonionic Polysaccharide 1 | 0.2 |
| Nonionic Surfactant 2 | 0.4 |
| Perfume | 1 |
| Water | Balance to 100 |
| **Formulation 4 (wt %)** | |
| Quat | 4 (active) |
| Cationic Polysaccharide 1 | 0.2 |
| Nonionic Polysaccharide 1 | 0.2 |
| Perfume | 1 |
| Water | Balance to 100 |

The samples were processed and the visual appearance of the samples was observed as described above in relation to Formulations 1 and 2. Results are shown in Table 4 below.

TABLE 4

| Formulation | Formulation 3 | Formulation 4 |
|---|---|---|
| Appearance | homogeneous | Phase separation, a top layer of the perfume occurred which was in yellow colour |

It was shown that the composition in which the perfume was pre-mixed with the nonionic surfactant exhibited excellent stability and no phase separation occurred in such composition.

Example 2: Effects of the Process of Pre-Mixing Nonionic Surfactant with Perfume Compositions were prepared according to the formulation in Table 5 below.

TABLE 5

| Formulation | Formulation 5 (wt %) | Formulation 6 (wt %) | Formulation 7 (wt %) |
|---|---|---|---|
| Quat | 4 (active) | 4 (active) | 4 (active) |
| Cationic Polysaccharide 1 | 0.2 | 0.2 | 0.2 |
| Nonionic Polysaccharide 1 | 0.2 | 0.2 | 0.2 |
| Nonionic Surfactant 1 | 0.4 | — | 0.4 |
| Perfume | 1 | 1 | 1 |
| Water | Balance to 100 | Balance to 100 | Balance to 100 |
| Total | 100 | 100 | 100 |

The composition of Formulation 5 was prepared by using the method for preparing the composition of Formulation 1 as described above and the composition of Formulation 6 was prepared by using the method for preparing the composition of Formulation 2 as described above, respectively. The composition of Formulation 7 was prepared by using the method described below:

1. Cationic Polysaccharide 1 and Nonionic Polysaccharide 1 were dispersed well in water with vortex;
2. HCl was added, with agitation, to adjust pH to be in the range of 4.5-5;
3. The mixture was heated to about 50° C.;
4. Quat was added to the mixture of (3) with stirring till homogeneous mixture is formed;
5. The resulting mixture was cooled down to room temperature in a water bath;
6. Perfume was added to the composition with stirring for 5 mins at 400 rpm.
7. Subsequently, Nonionic Surfactant 1 was added to the composition with stirring for 5 mins at 400 rpm.

Then the compositions were processed and the visual appearance of the compositions was observed as described in Example 1. Results were shown in Table 6 below.

TABLE 6

| Formulation | Formulation 5 | Formulation 6 | Formulation 7 |
|---|---|---|---|
| Appearance | homogeneous | Phase separation, a top layer of the perfume occurred which was in yellow colour | Phase separation, a top layer of the perfume occurred which was in yellow colour |

It was shown that the composition in which the perfume was pre-mixed with the nonionic surfactant (Formulation 5) exhibited excellent stability and no phase separation occurred in such composition. In contrast, the composition in which no nonionic surfactant was added (Formulation 6) and the composition in which the nonionic surfactant and the perfume were added separately (Formulation 7) showed poor stability and phase separation occurred in such compositions.

Example 3 Softening Performance, Perfume Longevity and Stability Tests

Compositions were prepared according to the formulation in Table 7 below. The method for preparing Formulation 1 as described above was used for preparing the formulation in Table 7.

TABLE 7

| | Quat (wt %) | Nonionic polysaccharide (wt %) | Cationic polysaccharide (wt %) | Perfume (wt %) | Non-ionic Surf. 1 (wt %) | Water (wt %) |
|---|---|---|---|---|---|---|
| F8 | 4 (active) | Nonionic Polysaccharide 1 (0.2) | Cationic Polysaccharide 1 (0.2) | 0.3 | 0.4 | To 100 |
| F9 | 4 (active) | HEC (0.2) | Cationic Polysaccharide 1 (0.2) | 0.3 | 0.4 | To 100 |
| F10 | 4 (active) | HPMC K200 (0.2) | Cationic Polysaccharide 1 (0.2) | 0.3 | 0.4 | To 100 |
| F11 | 4 (active) | HPMC K35M (0.2) | Cationic Polysaccharide 1 (0.2) | 0.3 | 0.4 | To 100 |
| F12 | 4 (active) | Nonionic Polysaccharide 1 (0.2) | LR 3000 KC (0.2) | 0.3 | 0.4 | To 100 |
| F13 | 4 (active) | Nonionic Polysaccharide 1 (0.2) | LR 400 (0.2) | 0.3 | 0.4 | To 100 |
| F14 | 4 (active) | Nonionic Polysaccharide 1 (0.2) | Konjac Gum (0.2) | 0.3 | 0.4 | To 100 |
| F15 | 4 (active) | Nonionic Polysaccharide 1 (0.4) | — | 0.3 | 0.4 | To 100 |
| F16 | 4 (active) | HEC (0.4) | — | 0.3 | 0.4 | To 100 |
| F17 | 4 (active) | HPMC K200 (0.4) | — | 0.3 | 0.4 | To 100 |
| F18 | 4 (active) | HPMC K35M (0.4) | — | 0.3 | 0.4 | To 100 |
| F19 | 4 (active) | — | Cationic Polysaccharide 1 (0.4) | 0.3 | 0.4 | To 100 |
| F20 | 4 (active) | — | LR 3000 KC (0.4) | 0.3 | 0.4 | To 100 |
| F21 | 4 (active) | — | LR 400 (0.4) | 0.3 | 0.4 | To 100 |
| F22 | 4 (active) | — | Konjac Gum (0.4) | 0.3 | 0.4 | To 100 |
| F23 | 4 (active) | Nonionic Polysaccharide 1 (0.2) | Cationic Polysaccharide 1 (0.2) | 0.6 | 0.4 | To 100 |
| F24 | 4 (active) | HEC (0.2) | Cationic Polysaccharide 1 (0.2) | 0.6 | 0.4 | To 100 |
| F25 | 4 (active) | HPMC K200 (0.2) | Cationic Polysaccharide 1 (0.2) | 0.6 | 0.4 | To 100 |
| F26 | 4 (active) | HPMC K35M (0.2) | Cationic Polysaccharide 1 (0.2) | 0.6 | 0.4 | To 100 |
| F27 | 4 (active) | Nonionic Polysaccharide 1 (0.2) | LR 3000 KC (0.2) | 0.6 | 0.4 | To 100 |
| F28 | 4 (active) | Nonionic Polysaccharide 1 (0.2) | LR 400 (0.2) | 0.6 | 0.4 | To 100 |
| F29 | 4 (active) | Nonionic Polysaccharide 1 (0.2) | Konjac Gum (0.2) | 0.6 | 0.4 | To 100 |
| F30 | 4 (active) | Nonionic Polysaccharide 1 (0.4) | — | 0.6 | 0.4 | To 100 |
| F31 | 4 (active) | HEC (0.4) | — | 0.6 | 0.4 | To 100 |
| F32 | 4 (active) | HPMC K200 (0.4) | — | 0.6 | 0.4 | To 100 |
| F33 | 4 (active) | HPMC K35M (0.4) | — | 0.6 | 0.4 | To 100 |
| F34 | 4 (active) | — | Cationic Polysaccharide 1 (0.4) | 0.6 | 0.4 | To 100 |

TABLE 7-continued

| | Quat (wt %) | Nonionic polysaccharide (wt %) | Cationic polysaccharide (wt %) | Perfume (wt %) | Non-ionic Surf. 1 (wt %) | Water (wt %) |
|---|---|---|---|---|---|---|
| F35 | 4 (active) | — | LR 3000 KC (0.4) | 0.6 | 0.4 | To 100 |
| F36 | 4 (active) | — | LR 400 (0.4) | 0.6 | 0.4 | To 100 |
| F37 | 4 (active) | — | Konjac Gum (0.4) | 0.6 | 0.4 | To 100 |

For the softening performance test, 2 grams of each of the composition samples were diluted in 1 liter water. Then towels were immersed into the water containing different samples (5 towels for each sample), respectively, for 10 mins. Then, the treated towels were drawn out, span for 5 mins and dried overnight. Then, the softness of each treated towel was evaluated by five panellists independently in which the panellist touched the treated towel and felt the softness of the treated towel (double-blinded test). The softness of the treated towels was rated in a scale of 1 to 5, wherein 1 represents the lowest softness and 5 represents the highest softness. Subsequently, the average softness rating of the towels treated by the same sample (n=25) was calculated.

For the perfume longevity test, 2 gram of each of the samples were diluted in 1 liter water. Then towels were immersed into the water containing different samples (one towel for each sample), respectively, for 10 mins. Then, the treated towels were drawn out, span for 5 mins, and subsequently dried overnight. Then, the strength of the odour of each treated towel was rated by 10 panellists independently (double-blinded test). The strength of the odour of the treated towels was rated in a scale of 1 to 4, wherein 1 represents the weakest odour and 4 represents the strongest odour. Subsequently, the average odour strength rating of the towels treated by the same sample (n=10) was calculated.

For assessing the stability of the compositions, the samples were processed and the visual appearance of the compositions was observed as described in Example 1.

Results were shown in Table 8 below.

TABLE 8

| | Average softness rating | Average odour strength rating | Appearance |
|---|---|---|---|
| F8 | 4.25 | 1.75 | Homogenous |
| F9 | 4.25 | 1.5 | Homogenous |
| F10 | 4.5 | 1.5 | Homogenous |
| F11 | 4.25 | 1.25 | Homogenous |
| F12 | 4.25 | 1.75 | Homogenous |
| F13 | 4.25 | 1.75 | Homogenous |
| F14 | 4 | 1.75 | Homogenous |
| F15 | 4 | 0.75 | Homogenous |
| F16 | 3.5 | 0.75 | Homogenous |
| F17 | 3.25 | 0.75 | Homogenous |
| F18 | 3.5 | 0.75 | Homogenous |
| F19 | 3.25 | 0 | Homogenous |
| F20 | 3.25 | 0 | Homogenous |
| F21 | 2.5 | 0.25 | Homogenous |
| F22 | 2.75 | 0 | Homogenous |
| F23 | 4.3 | 3.2 | Homogenous |
| F24 | 4.2 | 2.9 | Homogenous |
| F25 | 4.5 | 3 | Homogenous |
| F26 | 4.2 | 2.8 | Homogenous |
| F27 | 4.3 | 3.3 | Homogenous |
| F28 | 4.25 | 2.6 | Homogenous |
| F29 | 4 | 2.8 | Homogenous |

TABLE 8-continued

| | Average softness rating | Average odour strength rating | Appearance |
|---|---|---|---|
| F30 | 4 | 2 | Homogenous |
| F31 | 3.5 | 2 | Homogenous |
| F32 | 3.25 | 2 | Homogenous |
| F33 | 3.5 | 2 | Homogenous |
| F34 | 3.25 | 1.5 | Homogenous |
| F35 | 3.25 | 1.5 | Homogenous |
| F36 | 2.5 | 1.5 | Homogenous |
| F37 | 2.75 | 1.4 | Homogenous |

Results shown that the compositions which comprise combination of quat, cationic polysaccharide, nonionic polysaccharide and nonionic surfactant exhibited enhanced softening performance and enhanced perfume delivery ability. Also, the compositions showed excellent stability.

Should the disclosure of any patents, patent applications, and publications which are incorporated herein by reference conflict with the description of the present application to the extent that it may render a term unclear, the present description shall take precedence.

The invention claimed is:

1. A method for preparing a homogenous liquid composition comprising mixing a mixture of:

a quaternary ammonium compound, a cationic polysaccharide, wherein the cationic polysaccharide is present at from 0.2 to 10 wt. % of the composition, and optionally a nonionic polysaccharide, with a mixture of a fragrance material or perfume and a nonionic surfactant, wherein the quaternary ammonium compound has the general formula (III):

$$[N^{+}((CH_2)_n\text{-}T\text{-}R_8)_m(R_9)_{4-m}]_yX^{-} \quad \text{(III)}$$

wherein:

$R_8$ group is independently selected from $C_1$-$C_{30}$ alkyl or alkenyl group;

$R_9$ group is independently selected from $C_1$-$C_4$ alkyl or hydroxylalkyl group;

T is —C(═O)—O— or —O—C(═O)—;

n is an integer from 0 to 5;

m is selected from 1, 2 and 3;

X is an anion, for example a chloride, bromide, nitrate or methosulphate ion;

y is the valence of X.

2. The method according to claim 1, wherein the cationic polysaccharide and the nonionic polysaccharide are mixed to form mixture (i), and the quaternary ammonium compound is mixed with the mixture (i).

3. The method according to claim 2, wherein the cationic polysaccharide and the nonionic polysaccharide are mixed with water to form the mixture (i).

4. The method according to claim 2, wherein the pH value of the mixture (i) is adjusted to be in the range of 3.5 to 5.

5. The method according to claim 1, wherein the cationic polysaccharide is a cationic guar.

6. The method according to claim 1, wherein the nonionic polysaccharide is a nonionic guar.

7. The method according to claim 1, wherein the nonionic surfactant is an alkoxylated compound.

8. The method according to claim 1, wherein the composition further comprises a silicone compound.

9. A composition made according to the method of claim 1.

10. A composition comprising:
(a) from 0.5 wt. % to 45 wt. % of a quaternary ammonium compound;
(b) from 0.01 wt. % to 10 wt. % of a fragrance material or perfume;
(c) from 0.1 wt. % to 5 wt. % of a nonionic surfactant;
(d) from 0.2 wt. % to 10 wt. % of a cationic polysaccharide;
(e) from 0.2 wt. % to 10 wt. % of a nonionic polysaccharide; and
(f) water;
wherein the weight percentages are based on the total weight of the composition, and the quaternary ammonium compound has the general formula (III):

$$[N^+((CH_2)_n\text{-T-}R_8)_m(R_9)_{4-m}]_yX^- \quad \text{(III)}$$

wherein:
$R_8$ group is independently selected from $C_1$-$C_{30}$ alkyl or alkenyl group;
$R_9$ group is independently selected from $C_1$-$C_4$ alkyl or hydroxylalkyl group;
T is —C(═O)—O— or —O—C(═O)—;
n is an integer from 0 to 5;
m is selected from 1, 2 and 3;
X is an anion, for example a chloride, bromide, nitrate or methosulphate ion;
y is the valence of X, and
wherein the composition is a homogeneous liquid.

11. A method for conditioning a fabric by using the composition according to claim 10.

12. A composition comprising:
(a) from 0.5 wt. % to 45 wt. % of a quaternary ammonium compound;
(b) from 0.3 wt. % to 10 wt. % of a fragrance material or perfume;
(c) from 0.1 wt. % to 5 wt. % of a nonionic surfactant;
(d) from 0.2 wt. % to 10 wt. % of a cationic polysaccharide;
(e) from 0.2 wt. % to 10 wt. % of a nonionic polysaccharide; and
(f) water;
wherein the weight percentages are based on the total weight of the composition, and the quaternary ammonium compound has the general formula (III):

$$[N^+((CH_2)_n\text{-T-}R_8)_m(R_9)_{4-m}]_yX^- \quad \text{(III)}$$

wherein:
$R_8$ group is independently selected from $C_1$-$C_{30}$ alkyl or alkenyl group;
$R_9$ group is independently selected from $C_1$-$C_4$ alkyl or hydroxylalkyl group;
T is —C(═O)—O— or —O—C(═O)—;
n is an integer from 0 to 5;
m is selected from 1, 2 and 3;
X is an anion, for example a chloride, bromide, nitrate or methosulphate ion;
y is the valence of X, and
wherein the composition is a homogeneous liquid.

13. A composition comprising:
(a) from 0.5 wt. % to 45 wt. % of a quaternary ammonium compound;
(b) from 0.6 wt. % to 10 wt. % of a fragrance material or perfume;
(c) from 0.1 wt. % to 5 wt. % of a nonionic surfactant;
(d) from 0.2 wt. % to 10 wt. % of a cationic polysaccharide;
(e) from 0.2 wt. % to 10 wt. % of a nonionic polysaccharide; and
(f) water;
the weight percentages are based on the total weight of the composition, and the quaternary ammonium compound has the general formula (III):

$$[N^+((CH_2)_n\text{-T-}R_8)_m(R_9)_{4-m}]_yX^- \quad \text{(III)}$$

wherein:
$R_8$ group is independently selected from $C_1$-$C_{30}$ alkyl or alkenyl group;
$R_9$ group is independently selected from $C_1$-$C_4$ alkyl or hydroxylalkyl group;
T is —C(═O)—O— or —O—C(═O)—;
n is an integer from 0 to 5;
m is selected from 1, 2 and 3;
X is an anion, for example a chloride, bromide, nitrate or methosulphate ion;
y is the valence of X, and
wherein the composition is a homogeneous liquid.

14. A composition comprising:
(a) from 0.5 wt. % to 20 wt. % of a quaternary ammonium compound;
(b) from 0.1 wt. % to 5 wt. % of a fragrance material or perfume;
(c) from 0.2 wt. % to 4 wt. % of a nonionic surfactant;
(d) from 0.2 wt. % to 5 wt. % of a cationic polysaccharide;
(e) from 0.2 wt. % to 5 wt. % of a nonionic polysaccharide; and
(f) water;
the weight percentages are based on the total weight of the composition, and the quaternary ammonium compound has the general formula (III):

$$[N^+((CH_2)_n\text{-T-}R_8)_m(R_9)_{4-m}]_yX^- \quad \text{(III)}$$

wherein:
$R_8$ group is independently selected from $C_1$-$C_{30}$ alkyl or alkenyl group;
$R_9$ group is independently selected from $C_1$-$C_4$ alkyl or hydroxylalkyl group;
T is —C(═O)—O— or —O—C(═O)—;
n is an integer from 0 to 5;
m is selected from 1, 2 and 3;
X is an anion, for example a chloride, bromide, nitrate or methosulphate ion;
y is the valence of X, and
wherein the composition is a homogeneous liquid.

15. A composition comprising:
(a) from 0.5 wt. % to 20 wt. % of a quaternary ammonium compound;
(b) from 0.6 wt. % to 5 wt. % of a fragrance material or perfume;
(c) from 0.2 wt. % to 4 wt. % of a nonionic surfactant;
(d) from 0.2 wt. % to 5 wt. % of a cationic polysaccharide;
(e) from 0.2 wt. % to 5 wt. % of a nonionic polysaccharide; and
(f) water;
the weight percentages are based on the total weight of the composition, and the quaternary ammonium compound has the general formula (III):

$$[N^+((CH_2)_n\text{-T-}R_8)_m(R_9)_{4-m}]_yX^- \quad \text{(III)}$$

wherein:
$R_8$ group is independently selected from $C_1$-$C_{30}$ alkyl or alkenyl group;
$R_9$ group is independently selected from $C_1$-$C_4$ alkyl or hydroxylalkyl group;

T is —C(═O)—O— or —O—C(═O)—;

n is an integer from 0 to 5;

m is selected from 1, 2 and 3;

X is an anion, for example a chloride, bromide, nitrate or methosulphate ion;

y is the valence of X, and wherein the composition is a homogeneous liquid.

16. The composition according to claims 10, 12, 13, 14, or 15 further comprising a silicone compound.

* * * * *